United States Patent [19]

Luigi

[11] Patent Number: 4,476,961

[45] Date of Patent: Oct. 16, 1984

[54] PROCESS FOR PERFORMING THE CONSTRUCTION OF A PARKING GRIP CHOCK FOR A VEHICLE AND PARKING GRIP CHOCK FOR A VEHICLE MANUFACTURED FROM SHEET

[76] Inventor: Picotti Luigi, Frazione di Provaglio, Via Europa, 16, 25040 Camignone (Brescia), Italy

[21] Appl. No.: 447,648

[22] Filed: Dec. 7, 1982

[30] Foreign Application Priority Data

Dec. 16, 1981 [IT] Italy ..... 68630 A/81

[51] Int. Cl.[3] ..... B60T 3/00; B23K 31/00

[52] U.S. Cl. ..... 188/32; 228/173 C

[58] Field of Search ..... 188/32, 35, 36, 4 R, 188/5-9; 228/173 C, 170; D12/217; 410/30; 72/363, 362, 377, 378, 379

[56] References Cited

U.S. PATENT DOCUMENTS 2,956,646 10/1960 Isgren et al. ..... 188/32
3,993,167 11/1976 Reed ..... 188/32
4,363,436 12/1982 Evans et al. ..... 228/173 C X

*Primary Examiner*—Douglas C. Butler
*Attorney, Agent, or Firm*—Shlesinger Arkwright Garvey & Fado

[57] ABSTRACT

This invention relates to a parking grip chock made from sheet and to a process for the production of the same. The chock is substantially wedge-shaped and is characterized in that it is formed from a single piece blanked and bent provided with tongues folded at right angle and welded each other which define the supporting surface and the rear wall of the chock.

The process presents at least a blanking operation from a metal band of a flat blank having a predetermined shape, and a bending operation for subsequent operations on the blank in order that the same takes a wedge shape, bent edges of the blank being mutually welded.

11 Claims, 11 Drawing Figures

PROCESS FOR PERFORMING THE CONSTRUCTION OF A PARKING GRIP CHOCK FOR A VEHICLE AND PARKING GRIP CHOCK FOR A VEHICLE MANUFACTURED FROM SHEET

BACKGROUND OF THE INVENTION

This invention relates to a process for performing the construction of a parking grip chock for a vehicle, in particular for a truck. The present invention further relates to a parking grip chock for a vehicle manufactured from sheet.

It is known that during parking, particularly on sloping roads, vehicles, especially trucks and/or the respective trailers, are provided with parking grip chocks in relation with at least a pair of wheels, to avoid fortuitous displacements of the vehicle as a consequence of impacts, failure of the hand brake, or simply due to the vehicle weight. The known chocks are essentially wedge-shaped and have a support surface on the ground, and a surface opposite to the support surface and usually bent, apt to cooperate with a vehicle wheel. Such chocks are generally made from sheet and comprise a main body produced with a rectangular section of metal band folded on itself, in order to obtain a ring structure having in cross-section a substantially triangular shape, and two side walls, having a shape substantially triangular and provided with tongues bent at right angle and obtained by blanking and bending a sheet. The side walls are introduced inside the main body so as to close the open ends and thereafter secured by means of welding spots, in order to form the side walls of the chock and stiffen the main body. A wedge-shaped chock is thus obtained.

The chock sofar described has various disadvantages. The existence of three distinct elements requires, during the construction, an assembling operation and the application of numerous welding spots (about 40). The operation to obtain the side walls further causes plenty of scraps which are not reusable. Finally, the chock so obtained has a uniform thickness and equal to that of the original sheet and therefore needs the application of backing plates, especially on the rear wall, over which a handle is usually applied. In effect, the thickness of the sheet would be inadequate to support the handle. As a consequence, the final weight of the chock results comparatively high.

SUMMARY OF THE INVENTION

An object of the present invention is to realize a process to perform the construction of a parking grip chock for a vehicle, in particular for a truck, having a reduced production of scraps and needing a reduced number of welding spots.

A further object of the present invention is to realize a parking grip chock, made from sheet, having a reduced weight and obtainable in a simple and economic way without application of backing plates.

The aforesaid objects are attained by the present invention in that it relates to a process for performing the construction of a parking grip chock for a vehicle, in particular a truck, the said chock being produced from sheet and being substantially wedge-shaped, an upper surface of the said chock opposite to a lower supporting surface of the same being suited to cooperate with a wheel of the said vehicle, characterized in that it comprises:

at least a blanking operation, from a flat metal band, of a blank having a predetermined shape and consisting in a single flat piece, and at least a folding operation, carried out with successive stages, of the said blank in such a way to impart it a substantially wedge shape, the folded and overlapped edges being joined together.

The present invention further relates to a parking grip chock for a vehicle, in particular a truck, the said chock being produced from sheet and being substantially wedge-shaped, an upper surface of the said chock, opposite to a lower supporting surface of the same, being suited to cooperate with a wheel of the said vehicle, characterized in that it is formed from a single piece blanked and folded having a flat development substantially in the form of an isosceles trapezoid, a central portion of which determines the said upper surface, and two lateral and symmetrical portions of which determine two side walls of the said chock, a first pair of tongues bent at right angle and obtained integral with the said lateral portions determining a rear wall of the said chock and a second pair of tongues bent at right angle and obtained integral with the said lateral portions determining the said lower supporting surface of the said chock, said tongues being mutually secured by means of welding spots.

BRIEF DESCRIPTION OF THE DRAWINGS

For a better understanding of the present invention it is now given a non limiting description of an embodiment thereof with reference to the accompanying drawings, in which.

DETAILED DESCRIPTION OF THE INVENTION

Figure 1:
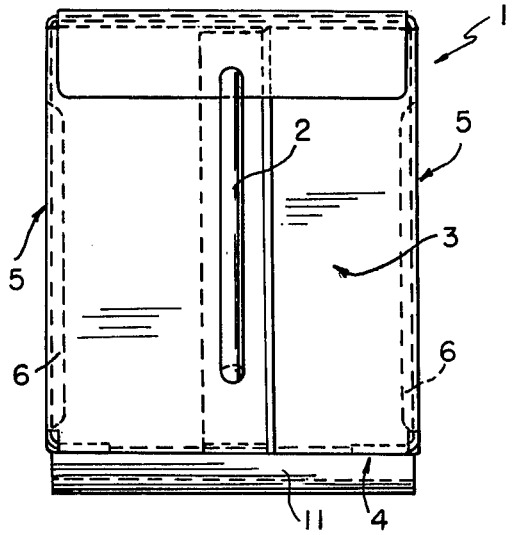
FIGS. 1, 2 and 3 show three orthogonal views of a parking grip chock embodying the present invention and provided with a grasping handle.
Figure 4:
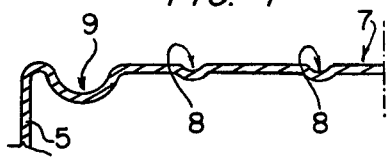
FIG. 4 shows a length of a cross-section of the chock of FIGS. 1, 2 and 3.
Figure 2:
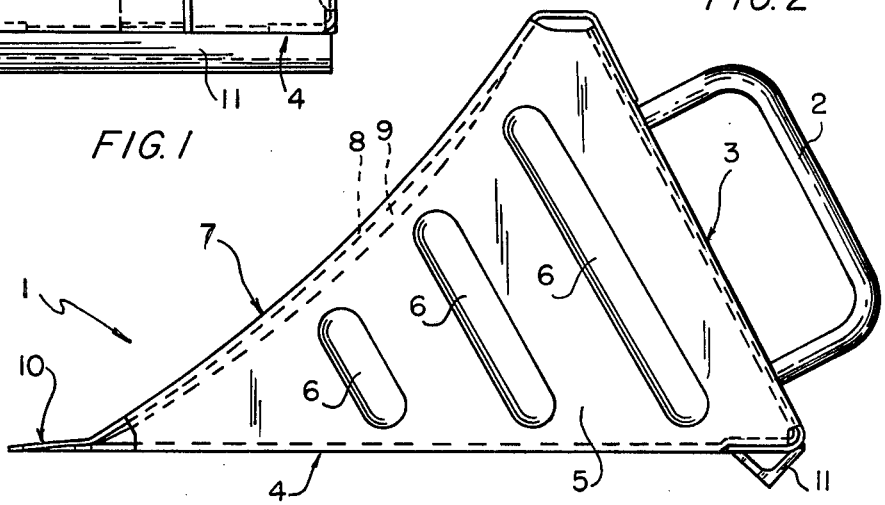
Figure 3:
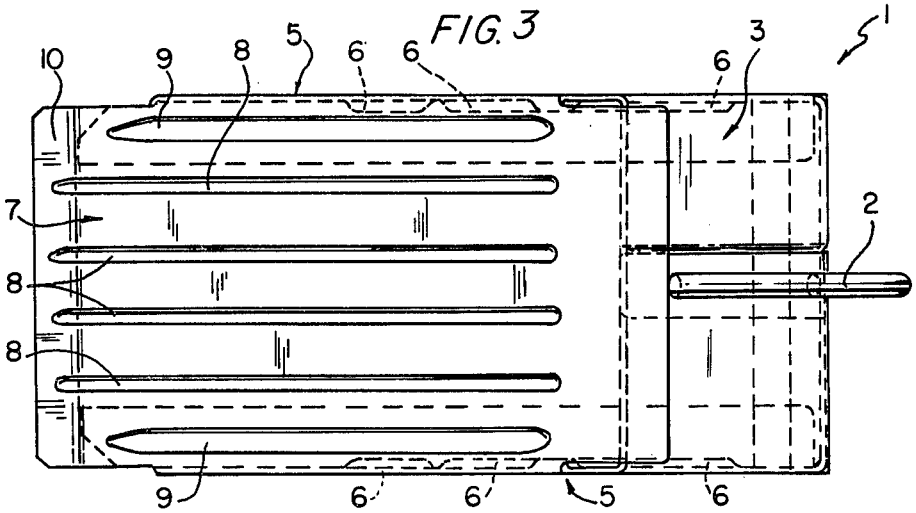
Figures 10, 11:
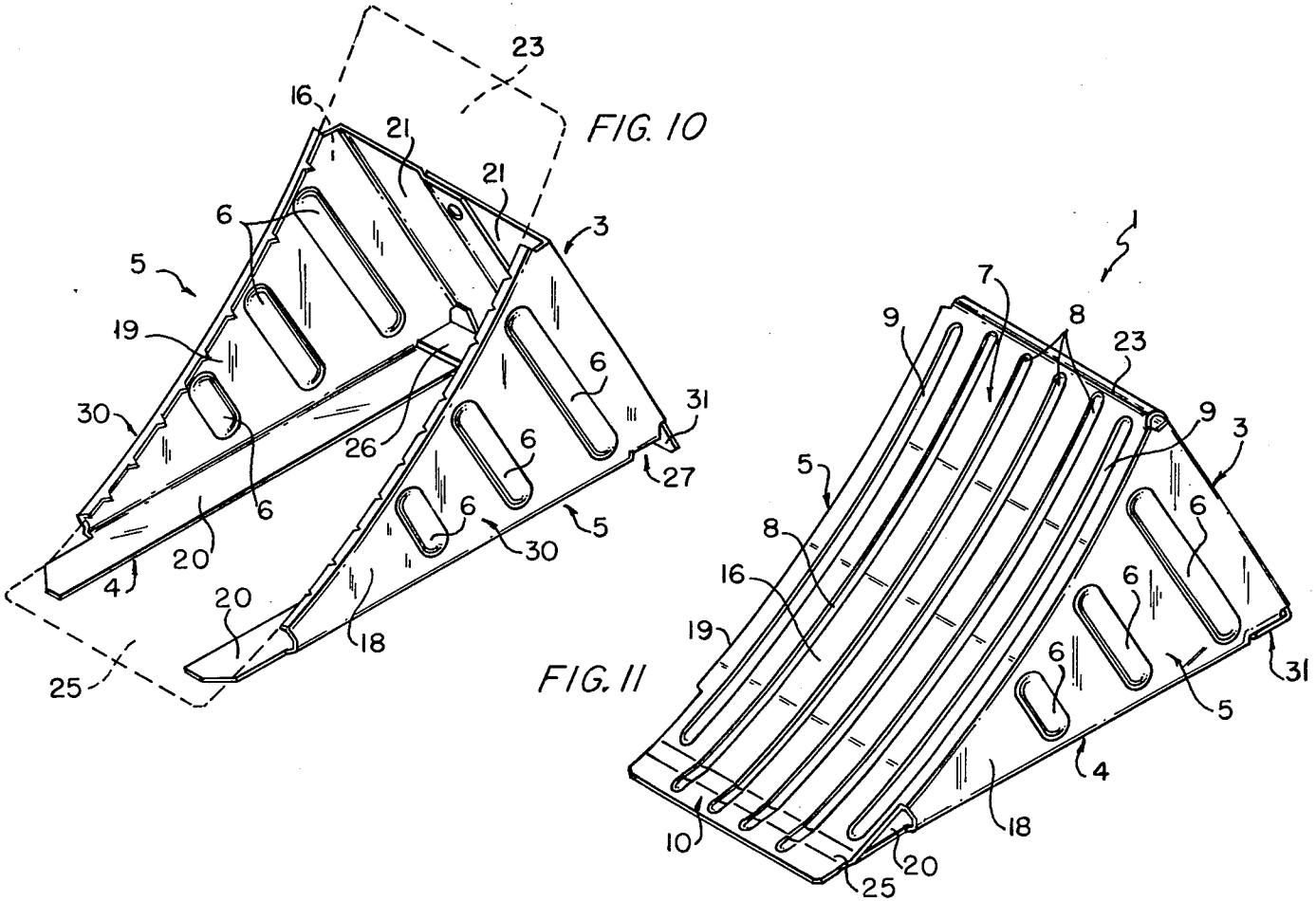
FIG. 11 is a perspective view of the chock of FIGS. 1, 2 and 3, with said handle omitted.

In FIGS. 1 to 3 and in FIG. 11 is shown a parking grip chock 1 made from sheet and being substantially wedge-shaped. The chock 1 according to FIGS. 1, 2 and 3 has a grasping handle 2 secured to it in relation with a rear wall 3 of the chock 1. The chock 1 has further a lower supporting surface 4, side walls 5 provided with stiffening bosses 6 obtained parallel to the rear wall 3, and an upper surface 7 opposite the surface 4 and suited to cooperate with a wheel, not shown, of a vehicle, to avoid displacements of the latter. The surface 7 has an arcuate longitudinal contour describing an arc of circumference with a relatively large radius and parallel to the side walls 5, and presents a plurality of stiffening longitudinal bosses 8 (FIG. 4) also parallel to the side walls 5. Moreover the surface 7 presents a pair of longitudinal bosses 9, parallel to the bosses 8, each arranged in proximity of the respective wall 5.

The chock 1 is further provided with anchor means to the ground comprising a flat tongue 10, extending in relation to the contact line between the surfaces 4 and 7 of the wall opposite the handle 2, and a L iron 11 welded transversally on the surface 4. The surface 7 is oblique to the surface 4 and forms with it a predetermined angle, corresponding to the angle of the wedge formed by the chock 1.

The chock 1 produced by means of a series of successive operations illustrated in FIGS. 5, 7, 8, 9 and 10 starting from a flat metal band 12, having a predetermined thickness, which is blanked in a skew direction relative to its longitudinal axis, so as to obtain, without the production of scraps, a plurality of flat symmetrical elements 13 having in plan the shape of an isosceles trapezoid, from each of which is afterwards trimmed an off-cuts 14 having a predetermined shape, in order to obtain from each element 13 a flat blank 15 having a predetermined shape and consisting of a single piece.

Figure 6:
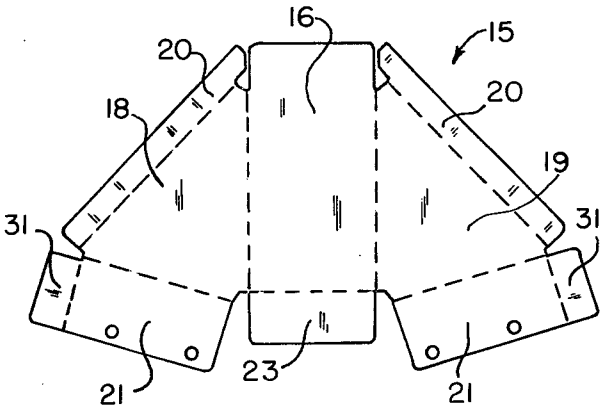
FIG. 6 shows a plan view of a blank obtained during the production of the chock of FIGS. 1, 2 and 3.
Figure 5:
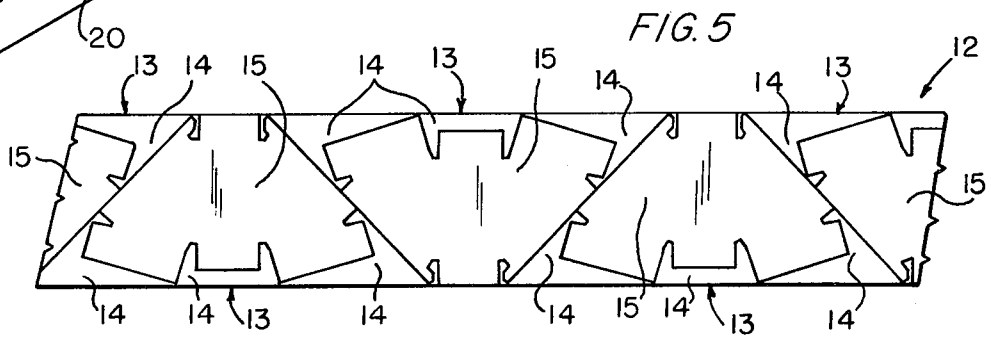
FIGS. 5, 7, 8, 9 and 10 show consecutive stages in the production of the chock of FIGS. 1, 2 and 3.
Figure 7:
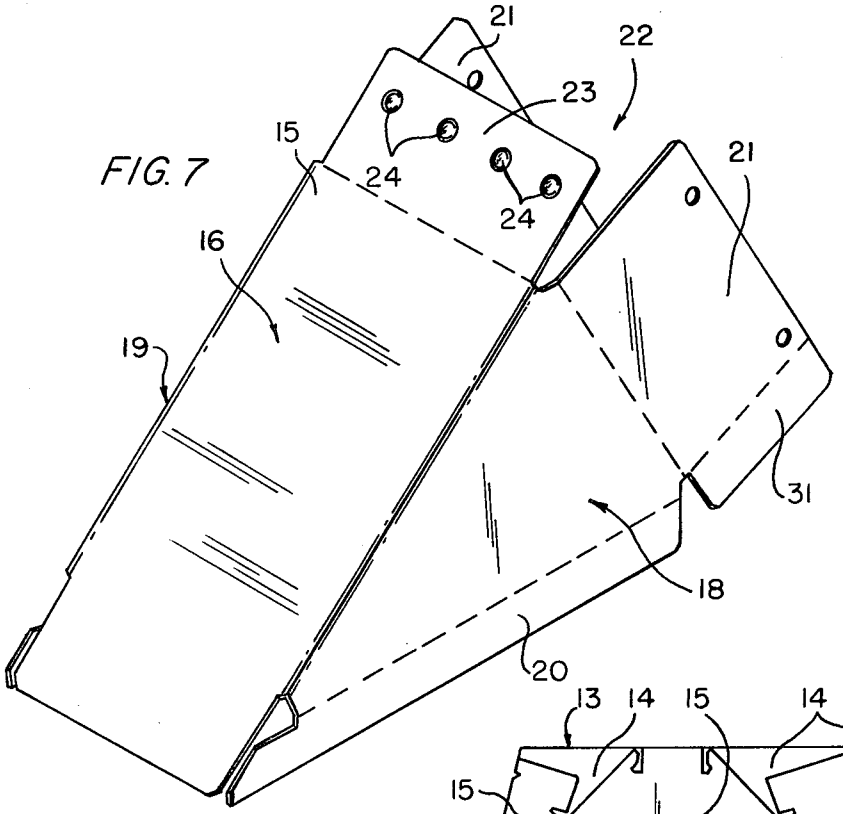
Figures 8, 9:
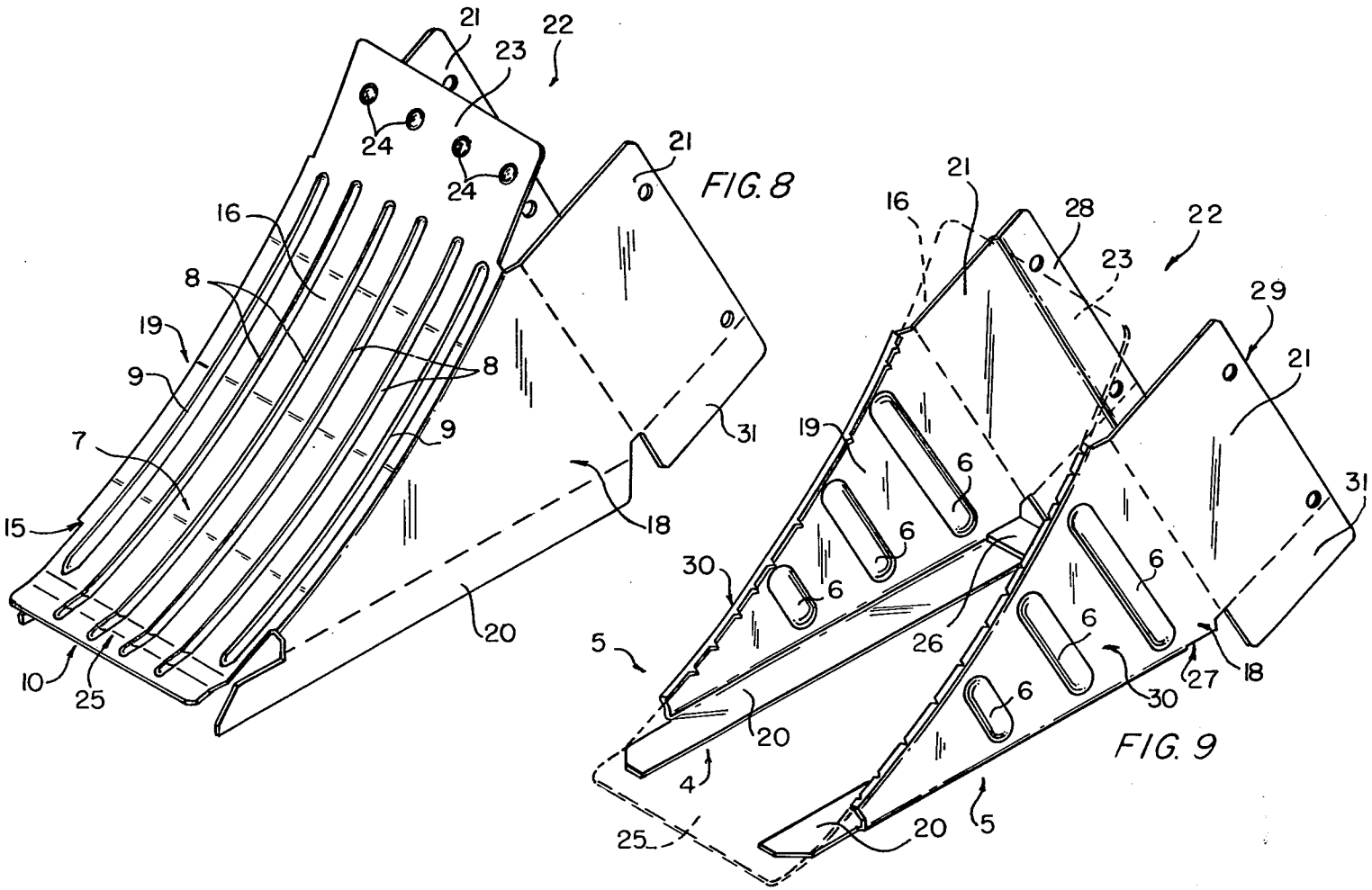

Obviously the aforesaid blanking operations can also be carried out simultaneously, obtaining directly from the band 12 the blanks 15. One of the blanks 15 is shown in FIG. 6. It includes a central portion 16 substantially rectangular, the smaller sides of which have the same size of the minor base of the element 13, and two lateral portions 18 and 19, symmetrical one another, each obtained in relation with one of the greater sides of the portion 16. Each portion 18 and 19 has in plan substantially the shape of a triangle, the base of which is formed by one of the greater sides of the portion 16 and the oblique sides of which are provided with respective tongues 20 and 21 substantially rectangular, obtained integral with portions 18 and 19.

Subsequently each blank 15, obtained with the said blanking operations, is submitted to a series of bending and pressing operations, so as to obtain, at the end of these, the chock 1 shown in FIG. 11. All the bending operations of the blank 15, which will be described later, are carried out along predetermined lines, illustrated in outlining on the blank of FIG. 6.

First the blank 15 is subjected to a bending operation by permanent deformation of the lateral portions 18 and 19 relative to the central portion 16, so that the blank 15 forms a U shaped solid 22 (FIG. 7) having the lateral portions 18 and 19 bent at right angle in coincidence of the greater sides of the rectangular central portion 16. During this bending operation, on an end portion 23 of the central portion 16, is also obtained a plurality of small bosses 24 substantially circular in plan. Afterwards (FIG. 8) it is carried out a forming operation by permanent deformation of the central portion 16, in order to obtain on the same a plurality of longitudinal bosses 8 and 9 parallel to the greater sides of portion 16 and having predetermined shape and size and, simultaneously, in order to deform an upper surface 7 of portion 16 oriented opposite to the lateral bent portions 18 and 19, giving to the surface 7 a curved longitudinal contour, apt to cooperate with the circular contour of a wheel, not shown. The bosses 9, bigger in size than the bosses 8, can allow the correct forming of the portion 16, constituting an outlet for the exceeding material arising from the accompanying profiling by permanent deformation of the portion 16 itself. During said operation, further, an extremity 25 of the portion 16, opposite the extremity 23, is pressed so as to make a flat shaped tongue 10, extending longitudinally.

After having completed the first bending operation and the following forming operation of the portion 16, a second bending operation is carried out on the tongues 20 and 21. By means of appropriate dies and devices the pair of tongues 20 is bent at right angle toward the interior of the solid 22, in order that the pair of tongues 20, which are obtained correspondently with the oblique sides of the starting trapezoidal element 13, can form a supporting lower surface 4, substantially flat. Moreover, it is obtained, on an extremity 26 of each tongue 20 facing the tongues 21, a step which can accommodate an edge of the tongues 21. On the tongue 21 of the portion 19 (or indifferently 18) it is further obtained a step 28 suited to accommodate a longitudinal edge 29 of the tongue 21 belonging to the opposite lateral portion (18 or, indifferently, 19). Finally, on an outer surface 30 of the lateral portions 18 and 19 are obtained a plurality of stiffening bosses 6, parallel to the tongues 21. In this way portions 18 and 19 form side walls 5, substantially triangular in shape, of a wedge defined by the opposite surfaces 4 and 7, which result mutually oblique and incident, and by said portions 18 and 19. Following said bending operation, it is bent at right angle, toward the interior of the solid 22, also the pair of tongues 21, the edge 29 of one of which is inserted correspondingly to the step 28 of the other tongue 21 (FIG. 10). In this way the bent tongues 21, which are obtained from the part of the major base of the starting trapezoidal element 13, define a rear wall 3 of the said wedge.

Finally, with a last bending operation, a lower extremity 31 of the tongues 21 is folded on the tongues 20 correspondingly to the relative steps 27 previously obtained on the latter, while the extremity 23 of the portion 16 is bent at right angle against the tongues 21. It is thus obtained the chock 1 illustrated in FIG. 11, in which the portion 16 defines the upper surface 7 of the chock 1, the tongues 20 the lower surface 4 of the same, the tongues 21 the rear wall 3 and the portions 18 and 19 the side walls 5. In order to impart a sufficient stiffness to the chock 1, the bent and overlapped edges of the blank 15 are mutually joined with any appropriate means, preferably with upset welding or electric spot welding. In particular, the two tongues 21 are mutually welded and the bent extremity 23 is in turn welded to the tongues 21, preferably by upset welding, correspondingly to the samll bosses 24. For better safety, the extremities 31 are also welded by means of a welding spot on the respective extremities 26 of the tongues 20. Optionally, the tongues 20 are welded by means of a corresponding welding spot to the extremities 25, so as to stiffen the base of the tongue 10. Finally, it is possible to fasten to the chock 1 of FIG. 11, by upsetting, a grasping handle 2, which is driven in holes 32 of the tongues 21, which holes can be punched directly during the described blanking operations of the blank 15. By means of the further welding of a L iron 11 on the surface 4 it is thus obtained the chock 1 illustrated in FIGS. 1, 2 and 3.

It is finally to be noted that the forming operation of the portion 16 is not strictly necessary and can therefore be omitted obtaining chocks 1 with a surface 7 flat rather than bent. Even in this case, anyway, the chock 1 is suited to avoid the movement of the wheel to which it is coupled.

From the above description the advantages according to the present invention will be clear. It allows to achieve a process for the production of parking grip chocks in a very simple and economic way, in that it includes only blanking and bending operations, and reduces to a minimum the required welding operations, eliminating furthermore possible assembling operations of intermediate parts, which are at the contrary necessary in the known processes.

Chiefly, the process according to the invention allows to work with a reduced production of scraps and to drastically reduce the number of required welding spots (from above forty to less than ten), making thus possible reduced consumptions of material and energy and a faster production run. The present invention further allows the production of a metallic chock simple and economic in construction, highly rugged and of reduced weight, which does not require stiffening plates. In effect in the areas more stressed the required thickness is obtained by means of overlapping joints of bent edges of a single element having a uniform thickness.

From the above description it is further evident that changes and variations to the the process and the chock according to the present invention can be made without departing from the scope of the invention itself.

I claim:

1. A process for performing the construction of a parking grip chock (1) for a vehicle, in particular for a truck, the said chock (1) being made from sheet and being substantially wedge-shaped, an upper surface (7) of the said chock (1), opposite to a supporting lower surface of the same, being suited to cooperate with a wheel of the said vehicle, characterized in that it comprises: at least a blanking operation, from a flat metallic band (12), of a blank (15) having a predetermined shape and obtained in a single flat piece, and at least a bending operation, carried out by means of consecutive operations, of the said blank (15), in order to impart to it a shape substantially wedged, bent and overlapped edges of the said blank being mutually joined.

2. A process according to claim 1, characterized in that it comprises the following operations:

a first blanking operation from the said metallic band (12) of a plurality of flat elements (13) having in plan the shape of an isosceles trapezoid;

a second blanking operation of a scrap (14) having a predetermined shape from each of the said trapezoidal elements (13), in order to obtain from each trapezoidal element (13) a said blank (15), the said blank (15) comprising a central portion (16) substantially rectangular, the smaller sides of which have the size of the minor base of the said trapezoidal element (13), and two lateral portions (18, 19), symmetrical one another, obtained correspondingly with one of the greater sides of the said central portion (16); each of the said side portions (18, 19) having in plan substantially the shape of a triangle, the base of which is formed by one of said greater sides of the said central portion (16) and the oblique sides of which are provided each with a substantially rectangular tongue (20, 21);

a third bending operation by permanent deformation of the said lateral portions (18, 19) of the said blank (15) in relation to the said central portion (16), such that the said blank (15) defines a U shaped solid (22) having the said lateral portions (18, 19) bent correspondingly to the said greater sides of the said central portion (16) perpendicularly to the latter;

a fourth bending operation of each of said rectangular tongue (20, 21) at right angle, toward the interior of said U shaped solid (22) defined by said blank (15), in order that a first pair of tongues (24) facing the major base of the said trapezoidal element (13) define a rear wall (3) of the said chock (1), and a second pair of tongues (20) obtained correspondingly to the oblique sides of said trapezoidal element (13) define the said supporting surface (4) of the said chock (1), the said upper surface (7) of the said chock being defined by the said central portion (16) of the said blank (15); and a fifth mutual spot welding operation of at least the said first pair of tongues (21).

3. A process according to claim 2, characterized in that the said first and second operations are carried out simultaneously.

4. A process according to claim 2, characterized in that it comprises further a forming operation by permanent deformation of the said central portion (16) of the said blank (15), in order to obtain on it a plurality of longitudinal bosses (8, 9) parallel to the said greater sides and having predetermined size and shape, and in order to permanently deform an upper surface (7) of the said central portion (16) opposite to the said bent lateral portions (18, 19), imparting to it a bent longitudinal contour; the said sixth operation being carried out between the said third and fourth operation.

5. A process according to claim 2, characterized in that a first extremity (23) of the said rectangular central portion (16) is bent at right angle over the said first pair of tongues (21) and spot welded on them correspondingly to a plurality of bosses (24) obtained on it during the said third operation.

6. A process according to claim 5, characterized in that the said second pair of tongues (20) is welded to a second extremity (25) of the said rectangular central portion (16) opposite the said first extremity (23).

7. A process according to claim 2, characterized in that during the said fourth operation a plurality of stiffening bosses (6) is obtained on the said lateral portions (18, 19).

8. A process according to claim 2, characterized in that a lower extemity (31) of the tongues (21) of the said first pair is folded over the tongues (20) of the said second pair, one of the tongues (21) of the said first pair having been previously deformed in order to produce a step (28) suited to accommodate a longitudinal edge (29) of the other tongue (21) of the said first pair of tongues (21).

9. A process according to claim 1, characterized in that after having imparted to the said blank (15) the said wedge shape, it is upset welded on it a grasping handle (2).

10. A parking grip chock (1) for a vehicle, in particular for a truck, characterized in that is it produced with the process according to claim 1.

11. A parking grip chock (1) for a vehicle, in particular for a truck, the said chock (1) being made from sheet and being substantially wedge-shaped, an upper surface (7) of the said chock (1), opposite to a supporting lower surface (4) of the same, being suited to cooperate with a wheel of the said vehicle, characterized in that it is formed from a single blanked and bent piece (15) having a flat development substantially with the shape of an isoseceles trapezoid, a central portion of which (16) defines the said upper surface (7) and two symmetrical lateral portions (18, 19) of which define two lateral walls (5) of the said chock (1), a first pair of tongues (21) bent at right angle and obtained integral with the said lateral portions (18, 19) defining a rear wall (3) of the said chock (1) and a second pair of tongues (20) bent at right angle and obtained integral with the said lateral portions (18, 19) defining the said supporting lower surface (4) of the said chock (1), the said tongues (20, 21) being mutually secured by means of welding spots.

* * * * *

UNITED STATES PATENT AND TRADEMARK OFFICE

CERTIFICATE OF CORRECTION

PATENT NO. : 4,476,961

DATED : October 16, 1984

INVENTOR(S) : Luigi Picotti

It is certified that error appears in the above-identified patent and that said Letters Patent is hereby corrected as shown below:

On the title page;
Inventor: Luigi Picotti, Frazione di Provaglio,
Via Europa, 16, 25040 Camignone
(Brescia), Italy Signed and Sealed this

*Sixteenth* Day of *July 1985*

[SEAL]

*Attest:*

DONALD J. QUIGG

*Attesting Officer* *Acting Commissioner of Patents and Trademarks*